US009776452B1

(12) United States Patent
Washington

(10) Patent No.: US 9,776,452 B1
(45) Date of Patent: Oct. 3, 2017

(54) MULTI-PURPOSE CONCEALING APPARATUS

(71) Applicant: Charles Edward Washington, Bronx, NY (US)

(72) Inventor: Charles Edward Washington, Bronx, NY (US)

( * ) Notice: Subject to any disclaimer, the term of this patent is extended or adjusted under 35 U.S.C. 154(b) by 0 days.

(21) Appl. No.: 15/166,295

(22) Filed: May 27, 2016

Related U.S. Application Data

(60) Provisional application No. 62/167,903, filed on May 29, 2015.

(51) Int. Cl.
*B44C 5/04* (2006.01)
*E06B 7/28* (2006.01)

(52) U.S. Cl.
CPC . *B44C 5/04* (2013.01); *E06B 7/28* (2013.01)

(58) Field of Classification Search
CPC .... B44C 5/04; E06B 7/28; E05G 1/02; E05G 1/024; E05G 1/026; E05G 1/04
USPC ..... 70/276, 416, 417, DIG. 34, DIG. 56, 70/DIG. 58; 109/50, 58, 69–73; 49/67, 49/158, 188, 189, 254; 312/291, 292; 16/250, 251, 402; 150/155; 292/251.5
See application file for complete search history.

(56) References Cited

U.S. PATENT DOCUMENTS 2,461,676 A * 2/1949 Budak ..... E05B 13/001 70/416
3,263,462 A 8/1966 Suroff et al.
3,414,306 A * 12/1968 Bernstein ..... E05B 13/001 292/1
3,647,165 A * 3/1972 Whitla ..... A62B 25/005 244/118.5
3,660,996 A * 5/1972 Syvertson ..... E05B 13/001 70/209
3,749,301 A * 7/1973 Peckar ..... B65D 5/6673 220/315
4,885,921 A * 12/1989 Sharav ..... E05B 13/001 292/DIG. 2
5,448,842 A * 9/1995 Sonstroem ..... G09F 3/20 40/331
5,953,860 A * 9/1999 Morgan ..... E05D 3/12 49/254
5,970,756 A * 10/1999 Miller ..... E05B 9/00 70/168

(Continued)

*Primary Examiner* — Lloyd Gall
(74) *Attorney, Agent, or Firm* — Ash Tankha; Lipton, Weinberger & Husick

(57) ABSTRACT

A multi-purpose concealing apparatus for concealing objects, for example, knobs, locks, etc., positioned on an external structure, for example, a door is provided. A first base member is attached to a frame of the external structure. A second base member is positioned on the external structure, adjacent to the first base member. The second base member defines a space for accommodating the objects and can accommodate auxiliary objects, for example, a key rack. Upper and lower slide elements are attached parallel to upper and lower inner panels respectively, and perpendicular to the second base member. Upper and lower outer panels of an enclosing structure slide against the upper and lower slide elements on the second base member to enclose the second base member. A concealing member is hingedly connected to the enclosing structure to conceal the objects. A magnetic board is attached to the inner surface of the concealing member.

20 Claims, 13 Drawing Sheets

(56) References Cited

U.S. PATENT DOCUMENTS

| | | | | |
|---|---|---|---|---|
| 7,278,284 | B1 | 10/2007 | James | |
| 7,404,363 | B2 * | 7/2008 | Dunstan | E05D 3/12 109/70 |
| 8,047,198 | B2 * | 11/2011 | Meyer | F24C 15/023 126/190 |
| 8,302,263 | B2 | 11/2012 | Washington | |
| 9,255,426 | B2 * | 2/2016 | Storey | E05B 17/14 |
| 2009/0260552 | A1 * | 10/2009 | Dunstan | E05D 3/12 109/70 |

* cited by examiner

MULTI-PURPOSE CONCEALING APPARATUS

CROSS-REFERENCE TO RELATED APPLICATIONS

This application claims priority to and the benefit of provisional patent application No. 62/167,903 titled "Multi-purpose Concealing Apparatus", filed in the United States Patent and Trademark Office on May 29, 2015. The specification of the above referenced patent application is incorporated herein by reference in its entirety.

BACKGROUND

The apparatus disclosed herein, in general, relates to covering a structure. More particularly, the apparatus disclosed herein relates to concealing objects, for example, door knobs, chain locks, deadbolts, bolt locks, etc., positioned on an external structure, for example, a door.

Homes and apartments have front entrance doors with doorknobs. In addition, homes and apartments also have a variety of objects, for example, door knobs, security devices such as chain locks, deadbolts, bolt locks, etc., positioned on the inner surfaces of their front entrance doors. The door knobs and the security devices are typically different in shape, sizes, colors, etc., and have different degrees of wear and tear. The appearance of multiple different objects on a front entrance door is not aesthetically appealing.

Hence, there is a long felt need for a multi-purpose concealing apparatus that conceals different objects positioned on an external structure, for example, a door. Furthermore, there is a need for a multi-purpose concealing apparatus that allows attachment of auxiliary objects, for example, a key rack, writing boards, etc., to the inner surfaces of the multi-purpose concealing apparatus, while concealing these auxiliary objects and maintaining the aesthetic appeal of the external structure.

SUMMARY OF THE INVENTION

This summary is provided to introduce a selection of concepts in a simplified form that are further disclosed in the detailed description of the invention. This summary is not intended to determine the scope of the claimed subject matter.

The multi-purpose concealing apparatus disclosed herein addresses the above mentioned needs for concealing objects, for example, door knobs, chain locks, deadbolts, bolt locks, etc., positioned on an external structure, for example, a door. The multi-purpose concealing apparatus disclosed herein allows attachment of auxiliary objects, for example, a key rack, writing boards, etc., to the inner surfaces of the multi-purpose concealing apparatus, while concealing these auxiliary objects and maintaining the aesthetic appeal of the external structure. The multi-purpose concealing apparatus disclosed herein comprises a first base member, a second base member, an upper inner panel, a lower inner panel, an upper slide element, a lower slide element, an enclosing structure, and a concealing member. The first base member is attached to a frame of the external structure. The first base member comprises an upper support panel and a lower support panel connected by a distal brace. The first base member further comprises an upper base panel and a lower base panel. The upper support panel of the first base member is attached substantially perpendicular to the upper base panel of the first base member. The lower support panel of the first base member is attached substantially perpendicular to the lower base panel of the first base member.

The second base member is positioned on the external structure, adjacent to the first base member. The outer surfaces of the second base member are fixedly attached to the external structure. The second base member comprises an upper section and a lower section connected by an intermediate section. The second base member defines a space for accommodating the objects positioned on the external structure. In an embodiment, an inner surface of the second base member comprises an attachment section configured to attach auxiliary objects, for example, a key rack to hang keys. The upper inner panel is attached substantially perpendicular to the upper section of the second base member. The lower inner panel is attached substantially perpendicular to the lower section of the second base member.

The upper slide element is attached substantially parallel to an outer surface of the upper inner panel and substantially perpendicular to the upper section of the second base member. The lower slide element is attached substantially parallel to an outer surface of the lower inner panel and substantially perpendicular to the lower section of the second base member. The enclosing structure comprises an upper outer panel and a lower outer panel connected by a rear panel. The rear panel is connected to distal ends of the upper outer panel and the lower outer panel. An inner surface of the upper outer panel and an inner surface of the lower outer panel are configured to slide against an outer surface of the upper slide element and an outer surface of the lower slide element respectively, to enclose the second base member in a closed position. The enclosing structure defines a space for further accommodating the objects positioned on the external structure.

The concealing member is connected to the rear panel of the enclosing structure via one or more hinges and positioned over the enclosed second base member to conceal the accommodated objects in the closed position. In an embodiment, an inner surface of the concealing member comprises an attachment section, for example, a magnetic attachment section for detachably attaching one or more auxiliary objects, for example, a magnetic dry erase board for posting items such as notices, reminders, pictures, signs, etc., thereon. In an embodiment, the multi-purpose concealing apparatus disclosed herein further comprises one or more magnetic elements and one or more latching elements. One or more magnetic elements are attached to an inner surface of the concealing member for magnetically connecting to one or more corresponding magnetic elements attached to the first base member to secure the concealing member to the first base member. The latching elements are attached to an upper section and/or a lower section of the inner surface of the concealing member and to the upper outer panel and/or the lower outer panel of the enclosing structure respectively for securing the concealing member to the enclosing structure.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a structure referenced by a numeral in a drawing is applicable to the description of that structure shown by that same numeral in any subsequent drawing herein.

DETAILED DESCRIPTION OF THE INVENTION

Figure 1:
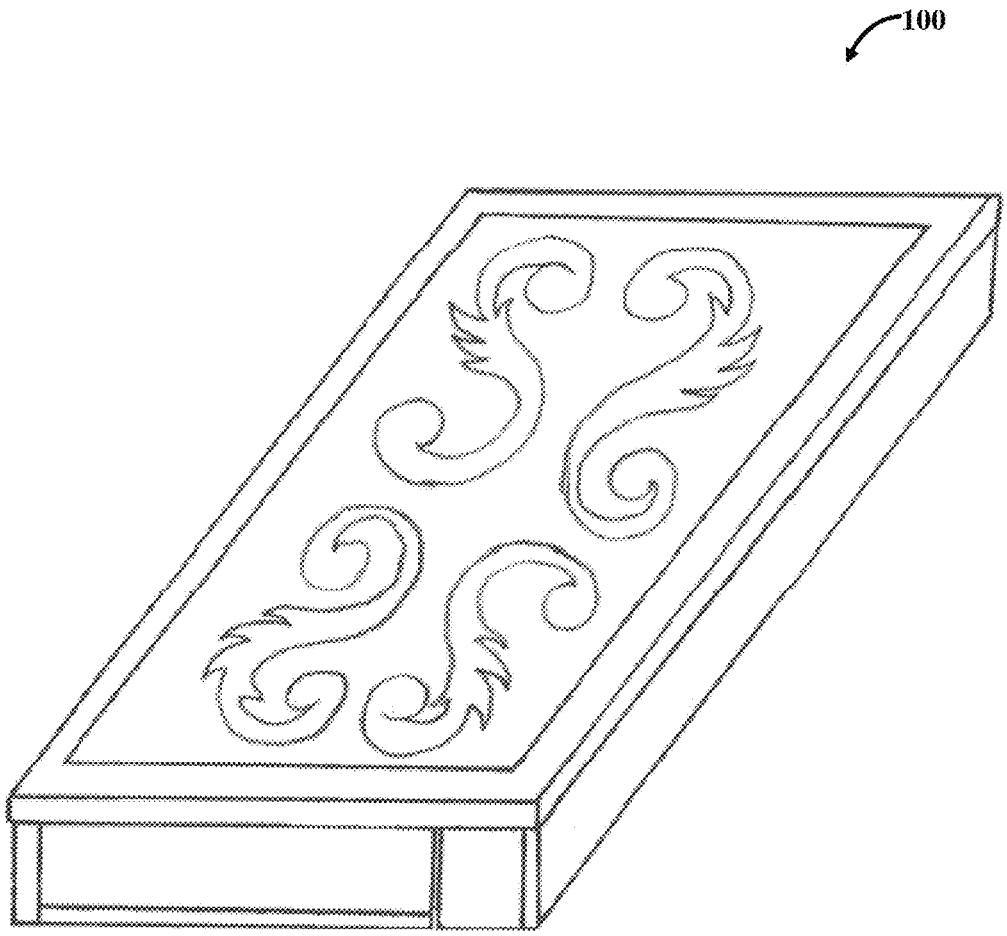
FIG. 1 exemplarily illustrates a perspective view of a multi-purpose concealing apparatus in a closed condition.

FIG. 1 exemplarily illustrates a perspective view of a multi-purpose concealing apparatus 100 in a closed condition. The multi-purpose concealing apparatus 100 disclosed herein is used for concealing objects, for example, a chain lock 124, a bolt lock 125, a door lock 126, and a door knob 127 positioned on an external structure, for example, a door 123 exemplarily illustrated in FIG. 4, a window, or any external structure on which objects, for example, 124, 125, 126, 127, etc., are attached and need to be concealed to increase an aesthetic appeal of the external structure. In an embodiment, the multi-purpose concealing apparatus 100 is configured in a geometrical shape, for example, a rectangular shape. The multi-purpose concealing apparatus 100 is made, for example, of wood or any durable material such as metal, acrylics, plastic, etc.

Figure 2A:
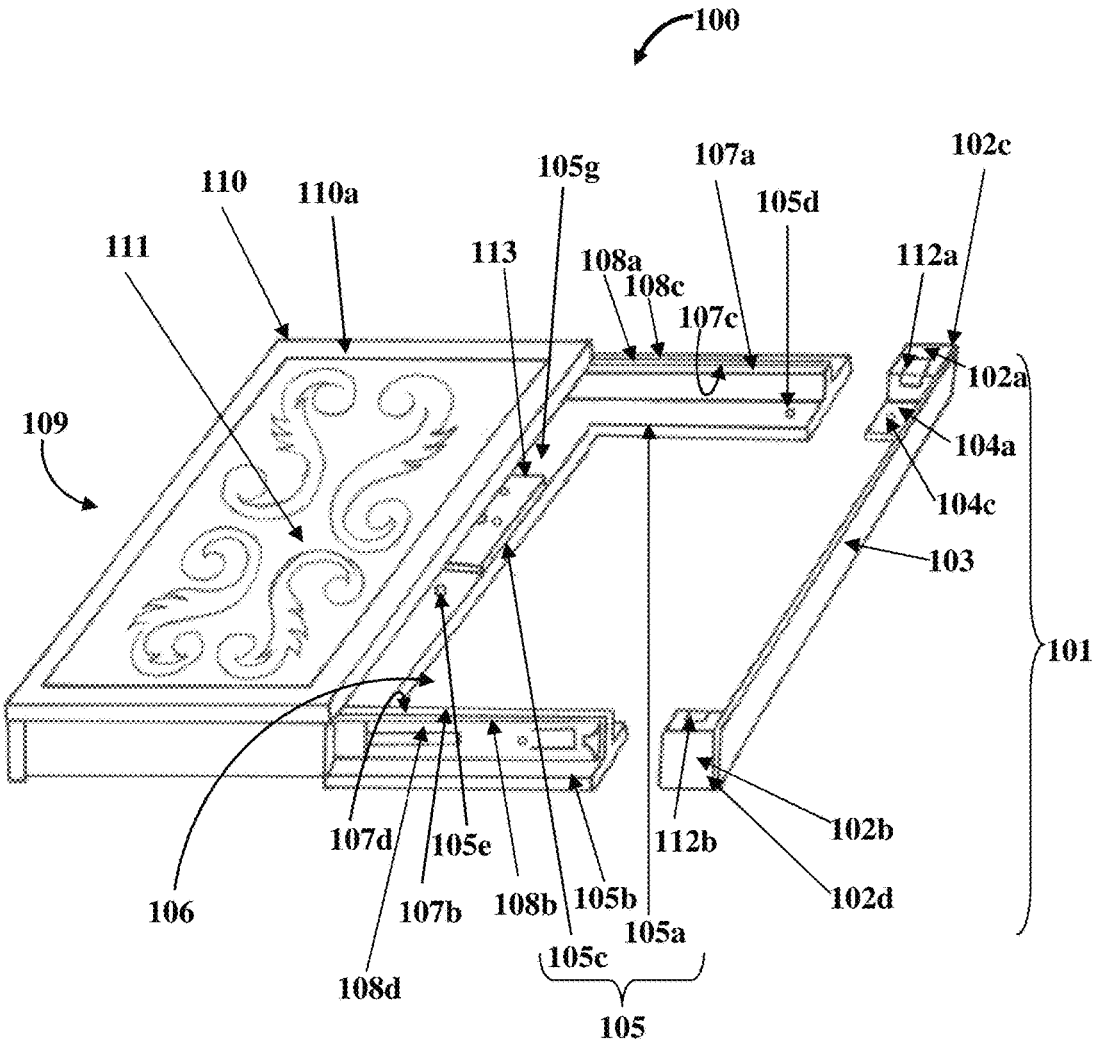
FIG. 2A exemplarily illustrates a perspective view of the multi-purpose concealing apparatus, showing an enclosing structure of the multi-purpose concealing apparatus in an open position and a concealing member of the multi-purpose concealing apparatus in a closed condition.
Figure 2B:
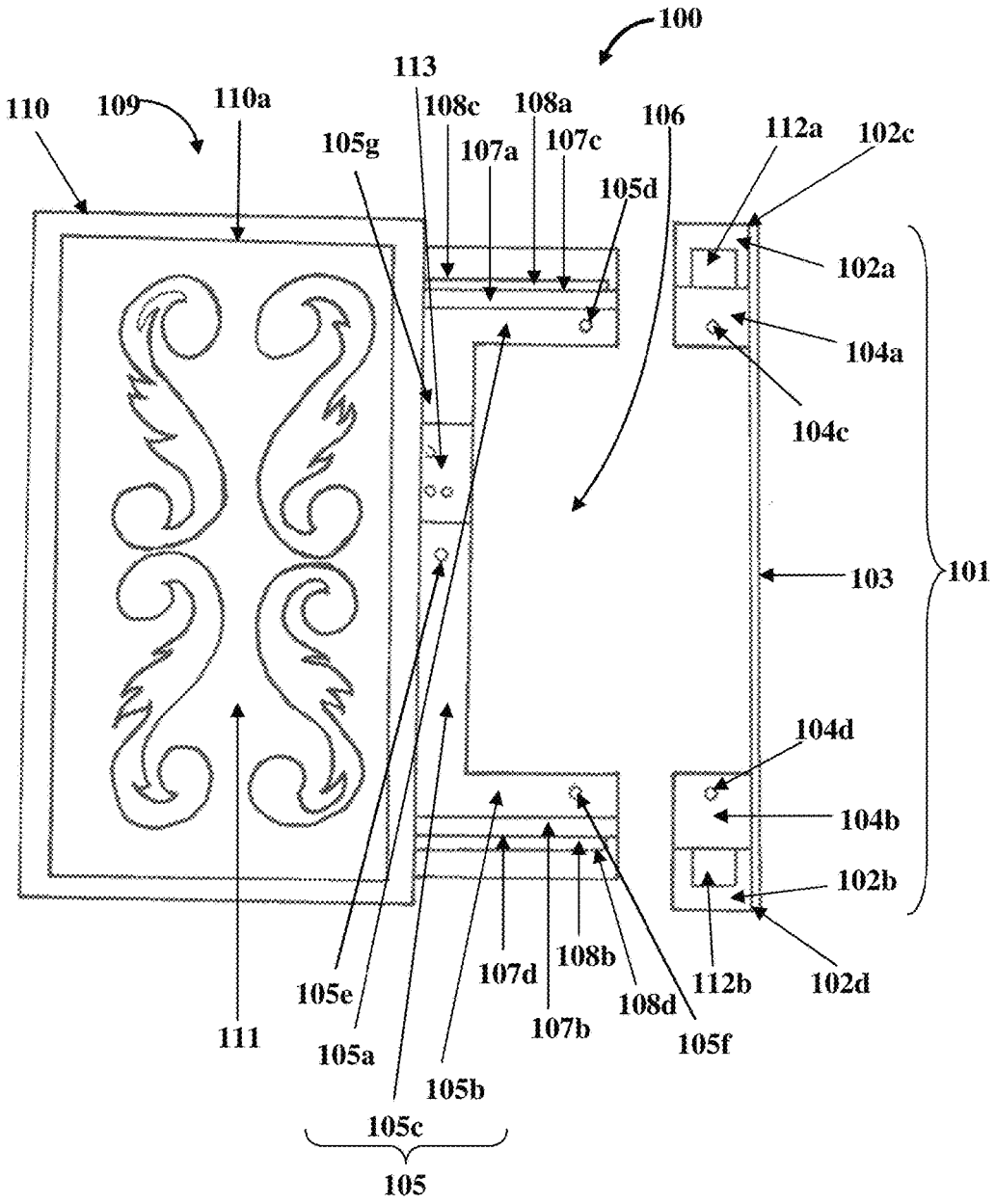
FIG. 2B exemplarily illustrates a front elevation view of the multi-purpose concealing apparatus, showing the enclosing structure of the multi-purpose concealing apparatus in an open position and the concealing member of the multi-purpose concealing apparatus in a closed condition.

FIG. 2A and FIG. 2B exemplarily illustrate a perspective view and a front elevation view of the multi-purpose concealing apparatus 100 respectively, showing an enclosing structure 109 of the multi-purpose concealing apparatus 100 in an open position and a concealing member 110 of the multi-purpose concealing apparatus 100 in a closed condition. The multi-purpose concealing apparatus 100 exemplarily illustrated in FIGS. 2A-2B, is in an open position. FIGS. 2A-2B shows the multi-purpose concealing apparatus 100 opened using slide elements 108*a* and 108*b*. The slide elements 108*a* and 108*b* are elements on which the enclosing structure 109 can slide to open and close the multi-purpose concealing apparatus 100.

As exemplarily illustrated in FIGS. 2A-2B, the multi-purpose concealing apparatus 100 disclosed herein comprises a first base member 101, a second base member 105, an upper inner panel 107*a*, a lower inner panel 107*b*, an upper slide element 108*a*, a lower slide element 108*b*, the enclosing structure 109, and the concealing member 110. The first base member 101 comprises an upper support panel 102*a*, a lower support panel 102*b*, an upper base panel 104*a*, a lower base panel 104*b*, and a distal brace 103. The upper support panel 102*a* and the lower support panel 102*b* of the first base member 101 are disposed on and are attached substantially perpendicular to the upper base panel 104*a* and the lower base panel 104*b* of the first base member 101 respectively. The upper base panel 104*a* and the lower base panel 104*b* of the first base member 101 comprise openings or holes 104*c* and 104*d* respectively, into which fasteners, for example, screws 120*a* and 120*b* can be inserted to fasten the first base member 101 to a frame 122 of an external structure, for example, a door 123 as exemplarily illustrated in FIG. 4. Distal ends 102*c* and 102*d* of the upper support panel 102*a* and the lower support panel 102*b* respectively, are connected to the distal brace 103. The distal brace 103 connects and supports the upper support panel 102*a* and the lower support panel 102*b*. In an embodiment, the multi-purpose concealing apparatus 100 disclosed herein further comprises magnetic elements 112*a* and 112*b* attached to the upper support panel 102*a* and the lower support panel 102*b* of the first base member 101.

The second base member 105 is positioned adjacent to the first base member 101. In an embodiment as exemplarily illustrated in FIGS. 2A-2B, the second base member 105 is configured as a C shaped base member. The second base member 105 comprises an upper section 105*a* and a lower section 105*b* connected by an intermediate section 105*c*. The second base member 105 defines a space 106 for accommodating multiple objects, for example, 124, 125, 126, and 127 positioned on an external structure, for example, a door 123 as exemplarily illustrated in FIG. 4. The second base member 105 comprises openings or holes 105*d*, 105*e*, and 105*f* configured on the upper section 105*a*, the intermediate section 105*c*, and the lower section 105*b* respectively, into which fasteners, for example, screws 121*a*, 121*c*, and 121*b* respectively, can be inserted to fasten the second base member 105 to the door 123 as exemplarily illustrated in FIG. 4. In an embodiment, an inner surface 105*g* of the second base member 105 comprises an attachment section 113 configured to attach auxiliary objects, for example, a key rack for hanging keys 128 exemplarily illustrated in FIGS. 9B-9C.

The upper inner panel 107*a* is attached substantially perpendicular to the upper section 105*a* of the second base member 105. The lower inner panel 107*b* is attached substantially perpendicular to the lower section 105*b* of the second base member 105. The upper slide element 108*a* is attached substantially parallel to an outer surface 107*c* of the upper inner panel 107*a* and substantially perpendicular to the upper section 105*a* of the second base member 105. The lower slide element 108*b* is attached substantially parallel to an outer surface 107*d* of the lower inner panel 107*b* and substantially perpendicular to the lower section 105*b* of the second base member 105. The enclosing structure 109 is disclosed in the detailed description of FIGS. 3A-3B. The concealing member 110 is hingedly connected to a rear panel 116 of the enclosing structure 109 exemplarily illustrated in FIGS. 3A-3B. In an embodiment, a decorative element 111 having one or more selective designs 110 is configured on an outer surface 110*a* of the concealing member 110. In another embodiment, the outer surface 110*a* of the concealing member 110 is configured as a display unit for displaying one or more decorative elements, for example, different types of art, sculptures, embellishments, paintings, photo frames, etc. In another embodiment, the outer surface 110*a* of the concealing member 110 is configured with magnetic properties for magnetically attaching one or more decorative elements on the door 123.

Figure 3A:
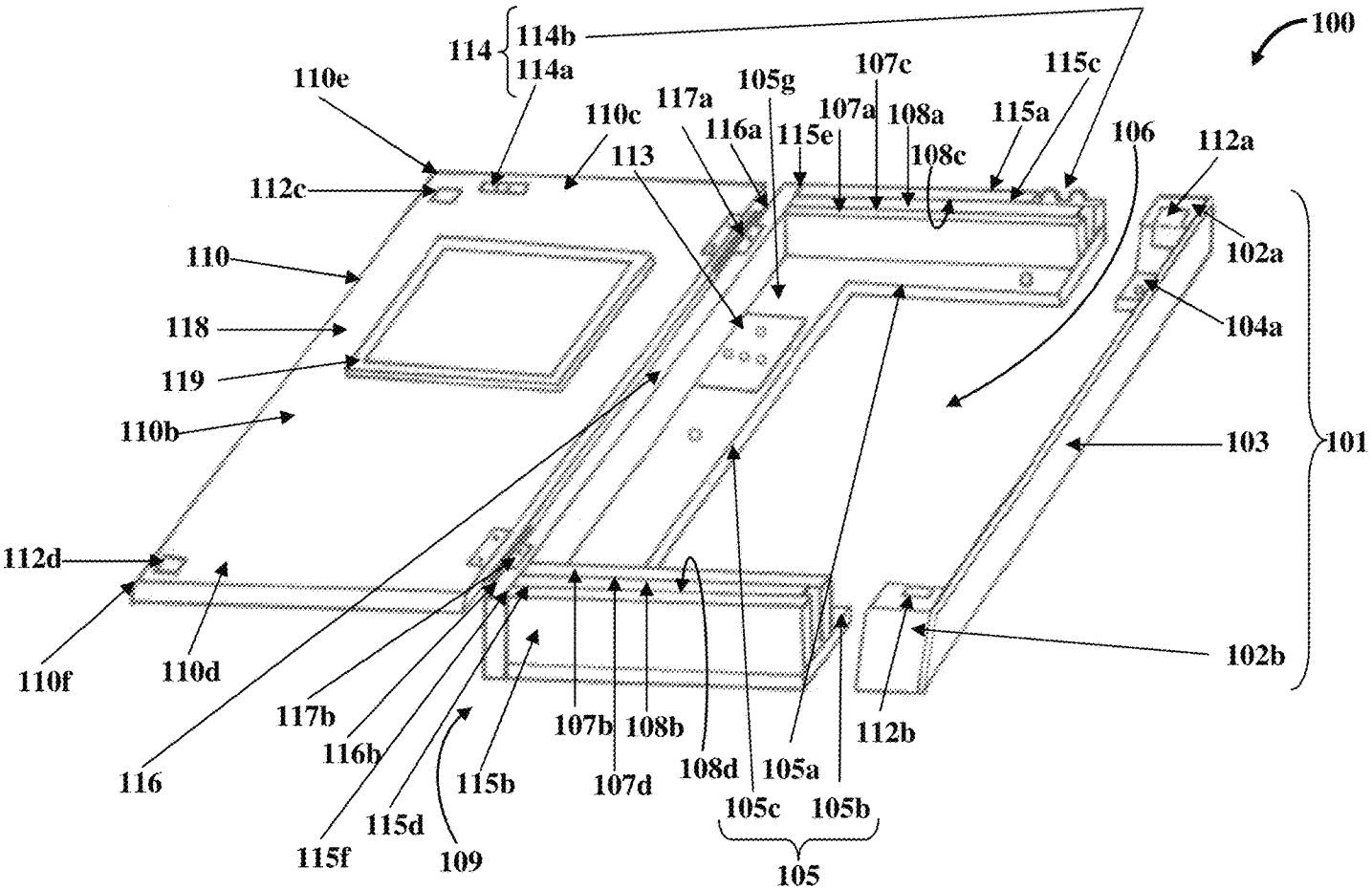
FIG. 3A exemplarily illustrates a perspective view of the multi-purpose concealing apparatus, showing the enclosing structure enclosing a second base member of the multi-purpose concealing apparatus in a closed position using slide elements, and the concealing member in an open condition.
Figure 3B:
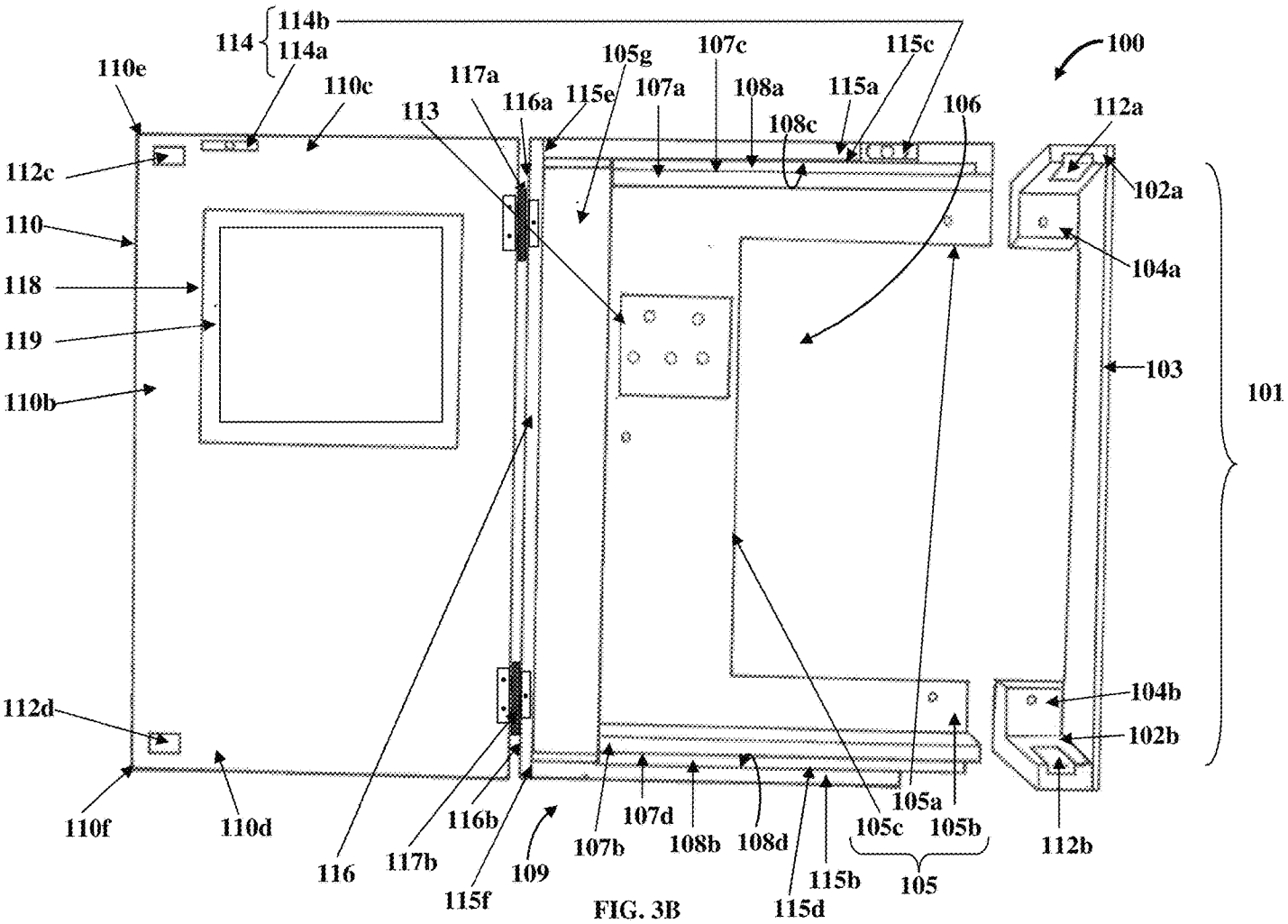
FIG. 3B exemplarily illustrates a front elevation view of the multi-purpose concealing apparatus, showing the enclosing structure enclosing the second base member of the multi-purpose concealing apparatus in a closed position using the slide elements, and the concealing member in an open condition.

FIGS. 3A-3B exemplarily illustrate a perspective view and a front elevation view of the multi-purpose concealing apparatus 100 respectively, showing the enclosing structure 109 enclosing the second base member 105 of the multi-purpose concealing apparatus 100 in a closed position using the slide elements 108*a* and 108*b*, and the concealing member 110 in an open condition. As exemplarily illustrated in FIGS. 3A-3B, the enclosing structure 109 comprises an upper outer panel 115*a* and a lower outer panel 115*b* connected by the rear panel 116. The rear panel 116 is connected to distal ends 115*e* and 115*f* of the upper outer panel 115*a* and the lower outer panel 115*b* respectively. An inner surface 115*c* of the upper outer panel 115*a* and an inner surface 115*d* of the lower outer panel 115*b* are configured to slide against an outer surface 108*c* of the upper slide element 108*a* and an outer surface 108*d* of the lower slide element 108*b* respectively, to enclose the second base member 105 in the closed position as exemplarily illustrated in FIGS. 3A-3B. In an embodiment, the upper slide element 108*a* and the lower slide element 108*b* are configured as drawer slides to allow the upper outer panel 115*a* and the lower outer panel 115*b* of the enclosing structure 109 to slide against the upper slide element 108*a* and the lower slide element 108*b* respectively, and support the sliding movement. The enclosing structure 109 defines a space configured to augment the space 106 defined by the second base member 105 and further accommodate multiple objects, for example, 124, 125, 126, and 127 positioned on an external structure, for example, a door 123 as exemplarily illustrated in FIG. 4.

The concealing member 110 is hingedly connected to the rear panel 116 of the enclosing structure 109, for example, via hinges 117*a* and 117*b* positioned on an upper edge 116*a* and a lower edge 116*b* of the rear panel 116 respectively. In an embodiment (not shown), the concealing member 110 is hingedly connected to the rear panel 116 of the enclosing structure 109 via a single hinge positioned at the center of the rear panel 116. In an embodiment as exemplarily illustrated in FIGS. 3A-3B, an inner surface 110*b* of the concealing member 110 comprises an attachment section, for example, a magnetic attachment section 118 for detachably attaching an auxiliary object, for example, a magnetic dry erase board 119 for posting items, for example, notices, reminders, pictures, signs, etc., thereon. In an embodiment, the multi-purpose concealing apparatus 100 disclosed herein further comprises magnetic elements 112*c* and 112*d* attached to an upper section 110*c* and a lower section 110*d* of the inner surface 110*b* of the concealing member 110 respectively. For example, the magnetic elements 112*c* and 112*d* are attached to an upper left corner 110*e* and a lower left corner 110*f* of the concealing member 110 respectively. The magnetic elements 112*c* and 112*d* of the concealing member 110 magnetically connect to corresponding magnetic elements 112*a* and 112*b* attached to the upper support panel 102*a* and the lower support panel 102*b* of the first base member 101 respectively, for securing the concealing member 110 to the first base member 101 and stabilizing the concealing member 110 on the first base member 101.

In an embodiment, the multi-purpose concealing apparatus 100 disclosed herein further comprises one or more latching elements 114 attached to the upper section 110*c* and/or the lower section 110*d* of the inner surface 110*b* of the concealing member 110 and the upper outer panel 115*a* and/or the lower outer panel 115*b* of the enclosing structure 109 respectively for securing the concealing member 110 to the enclosing structure 109. In an embodiment, each of the latching elements 114 comprises a ball catch 114*a* and a catch ball latch 114*b*. In an embodiment as exemplarily illustrated in FIGS. 3A-3B, the ball catch 114*a* is positioned on and attached to the upper section 110*c* of the inner surface 110*b* of the concealing member 110, while the corresponding catch ball latch 114*b* is positioned on and attached to the upper outer panel 115*a* of the enclosing structure 109. In another embodiment (not shown), the ball catch 114*a* is positioned on and attached to the lower section 110*d* of the inner surface 110*b* of the concealing member 110, while the corresponding catch ball latch 114*b* is positioned on and attached to the lower outer panel 115*b* of the enclosing structure 109. In another embodiment (not shown), ball catches 114*a* are positioned on and attached to the upper section 110*c* and the lower section 110*d* of the inner surface 110*b* of the concealing member 110, while the corresponding catch ball latches 114*b* are positioned on and attached to the upper outer panel 115*a* and the lower outer panel 115*b* of the enclosing structure 109. The ball catch 114*a* is configured to engageably connect to the catch ball latch 114*b* to secure and stabilize the concealing member 110 to the enclosing structure 109. For example, the ball catch 114*a* attached to the upper section 110*c* of the inner surface 110*b* of the concealing member 110 engageably connects to the catch ball latch 114*b* that is positioned on the upper outer panel 115*a* of the enclosing structure 109 to secure and stabilize the concealing member 110 to the enclosing structure 109 as exemplarily illustrated in FIGS. 3A-3B.

Figure 4:
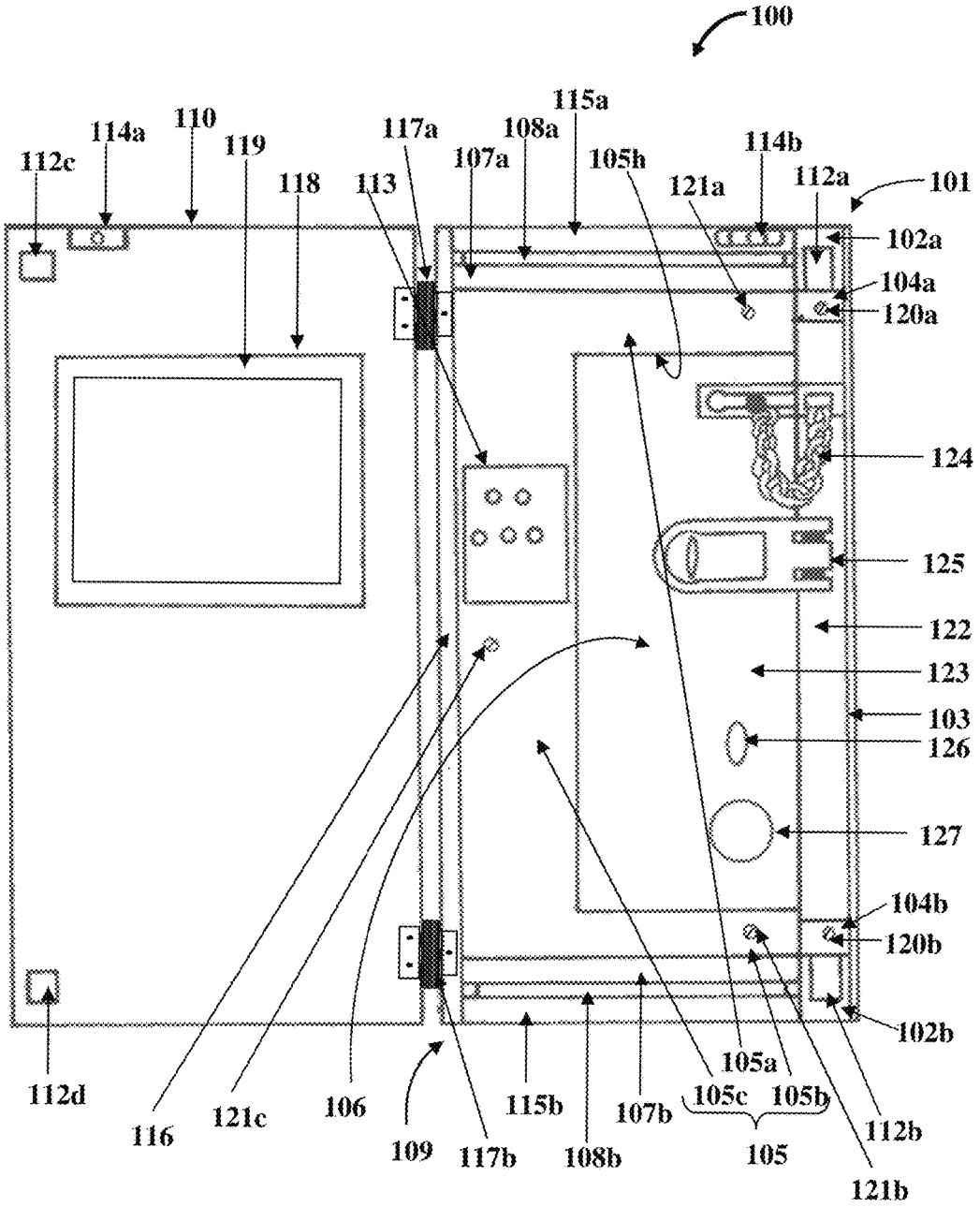
FIG. 4 exemplarily illustrates a front elevation view of the multi-purpose concealing apparatus positioned on an entire area of an external structure, showing the enclosing structure in the closed position and the concealing member opened via hinges to expose objects positioned on the external structure.

FIG. 4 exemplarily illustrates a front elevation view of the multi-purpose concealing apparatus 100 positioned on an entire area of an external structure, for example, a door 123, showing the enclosing structure 109 in the closed position and the concealing member 110 opened via the hinges 114*a* and 114*b* to expose multiple objects, for example, 124, 125, 126, and 127 positioned on the external structure. For purposes of illustration, the detailed description refers to the external structure being a door 123; however the scope of the multi-purpose concealing apparatus 100 disclosed herein is not limited to attachment to an external structure such as a door 123, but may be extended to attach to other external structures, for example, a window and other functionally equivalent external structures. The objects positioned on the door 123 comprise, for example, a chain lock 124, a bolt lock 125, a door lock 126, a door knob 127, surface locks, latches, deadbolts, etc., as exemplarily illustrated in FIG. 4. In an embodiment, the multi-purpose concealing apparatus 100 is constructed to cover an entire area of the door 123 as exemplarily illustrated in FIG. 4. In another embodiment, the multi-purpose concealing apparatus 100 is constructed to cover a partial area of the door 123 as disclosed in the detailed description of FIGS. 9A-9C.

The first base member 101 of the multi-purpose concealing apparatus 100 is attached to a frame 122 of the door 123. The upper base panel 104*a* and the lower base panel 104*b* of the first base member 101 are fixedly attached to the frame 122 of the door 123, for example, using screws 120*a* and 120*b* exemplarily illustrated in FIG. 4, inserted into openings or holes 104*c* and 104*d* configured in the upper base panel 104*a* and the lower base panel 104*b* respectively exemplarily illustrated in FIG. 2B and FIG. 3B. The second base member 105 of the multi-purpose concealing apparatus 100 is positioned on the door 123, adjacent to the first base member 101. Outer surfaces 105*h* of the second base member 105 are fixedly attached to the door 123, for example, using screws 121*a*, 121*b*, and 121*c* exemplarily illustrated in FIG. 4, inserted into openings or holes 105*d*, 105*f*, and 105*e* respectively configured in the second base member 105 exemplarily illustrated in FIG. 2B. The second base member 105 supports the upper inner panel 107*a* and the lower inner panel 107*b*, the upper outer panel 115*a* and the lower outer panel 115*b* of the enclosing structure 109, and the upper slide element 108*a* and the lower slide element 108*b*. The concealing member 110 is hingedly connected to the rear panel 116 of the enclosing structure 109, for example, via the hinges 117*a* and 117*b*, and positioned over the enclosed second base member 105 to conceal the accommodated objects, for example, 124, 125, 126, and 127 in the closed position.

Figure 5A:
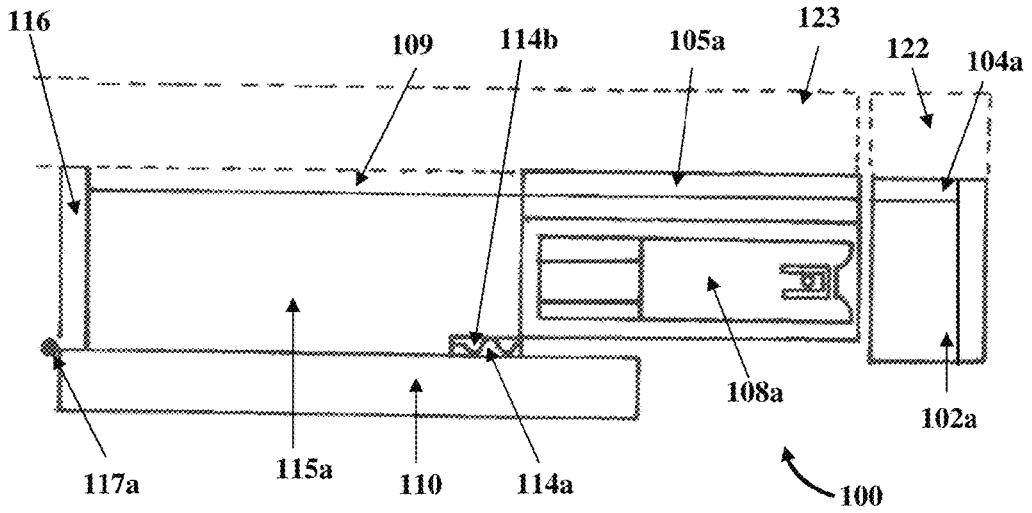
FIG. 5A exemplarily illustrates a top plan view of the multi-purpose concealing apparatus mounted on an external structure and opened using the slide elements of the multi-purpose concealing apparatus.
Figure 5B:
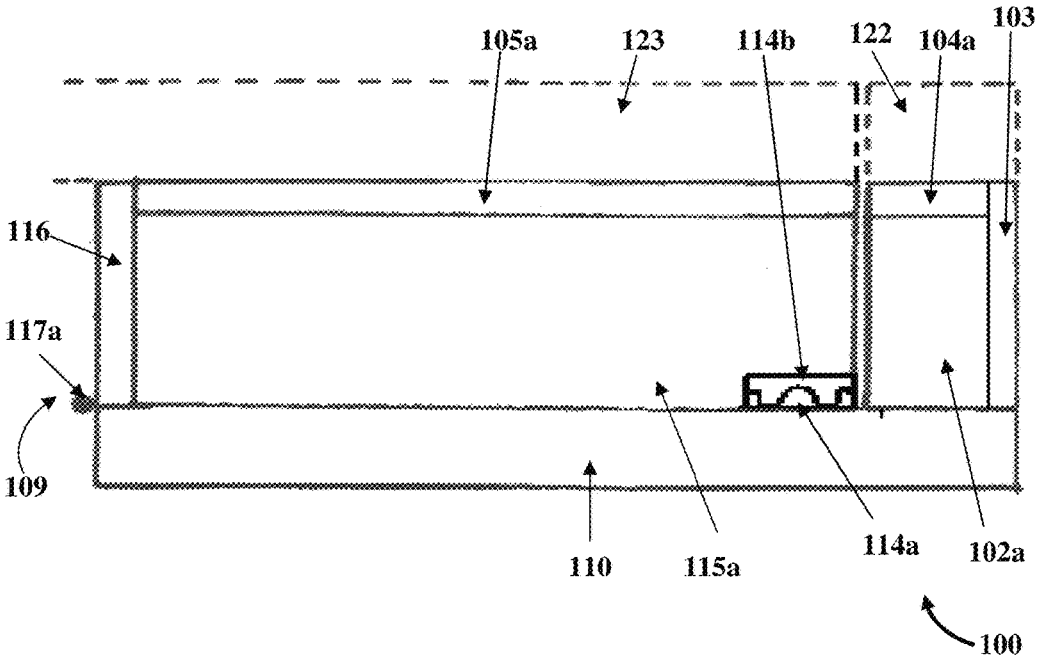
FIG. 5B exemplarily illustrates a top plan view of the multi-purpose concealing apparatus mounted on an external structure and closed using the slide elements of the multi-purpose concealing apparatus.

FIGS. 5A-5B exemplarily illustrate top plan views of the multi-purpose concealing apparatus 100 mounted on an external structure, for example, a door 123. FIG. 5A shows the enclosing structure 109 of the multi-purpose concealing apparatus 100 in an open position, while FIG. 5B shows the enclosing structure 109 in a closed position. As exemplarily illustrated in FIG. 5A, the enclosing structure 109 can be drawn out from the second base member 105 via the slide elements 108*a* and 108*b* exemplarily illustrated in FIGS. 2A-2B, to allow a user to access the objects, for example, 124, 125, 126, and 127 positioned on the door 123 exemplarily illustrated in FIG. 4, and the key rack that hangs keys 128 exemplarily illustrated in FIGS. 9B-9C. As exemplarily illustrated in FIG. 5B, the enclosing structure 109 can be slid over the second base member 105 using the slide elements 108*a* and 108*b*, and closed to conceal the objects, for example, 124, 125, 126, 127, and 128. The concealing member 110 of the multi-purpose concealing apparatus 100 is secured to the upper outer panel 115*a* of the enclosing structure 109 by connecting the ball catch 114*a* to the catch ball latch 114*b* as exemplarily illustrated in FIG. 5B. The enclosing structure 109 defines an augmented space 106 for accommodating the objects, for example, 124, 125, 126, and 127 positioned on the door 123 as exemplarily illustrated in FIG. 4.

Figure 6:
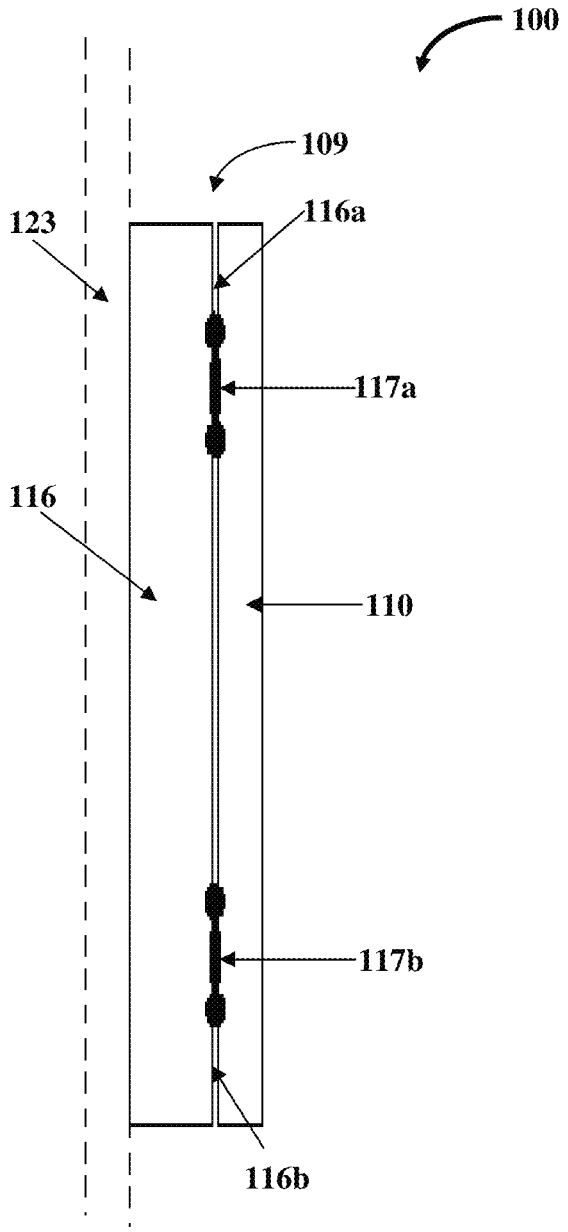
FIG. 6 exemplarily illustrates a left side elevation view of the multi-purpose concealing apparatus mounted on an external structure, showing a rear panel of the enclosing structure with hinges.

FIG. 6 exemplarily illustrates a left side elevation view of the multi-purpose concealing apparatus 100 mounted on an external structure, for example, a door 123, showing the rear panel 116 of the enclosing structure 109 with the hinges 117*a* and 117*b*. The concealing member 110 is connected to the rear panel 116 via an upper hinge 117*a* attached to the upper edge 116*a* of the rear panel 116 and a lower hinge 117*b* attached to the lower edge 116*b* of the rear panel 116 as exemplarily illustrated in FIG. 6.

Figure 7:
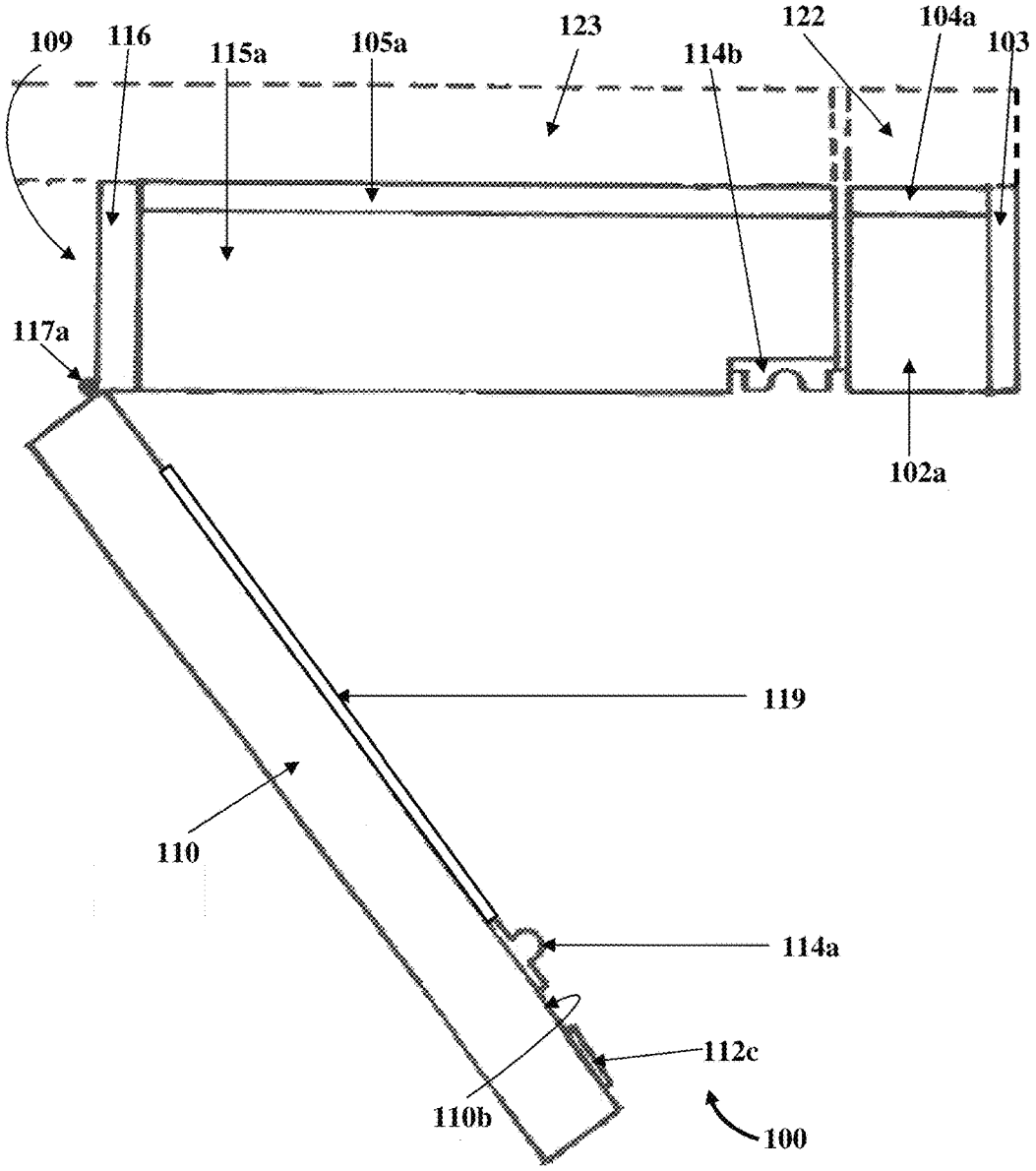
FIG. 7 exemplarily illustrates a top plan view of the multi-purpose concealing apparatus mounted on an external structure, showing the concealing member opened via the hinges of the rear panel of the enclosing structure.

FIG. 7 exemplarily illustrates a top plan view of the multi-purpose concealing apparatus 100 mounted on an external structure, for example, a door 123, showing the concealing member 110 opened via the hinges 117*a* and 117*b* of the rear panel 116 of the enclosing structure 109. A user may disengage the ball catch 114*a* positioned on the inner surface 110*b* of the concealing member 110 from the catch ball latch 114*b* positioned on the upper outer panel 115*a* of the enclosing structure 109 to open the concealing member 110 via the hinges 117*a* and 117*b* and expose the magnetic dry erase board 119 for posting items, for example, notices, reminders, pictures, signs, etc., thereon.

Figure 8A:
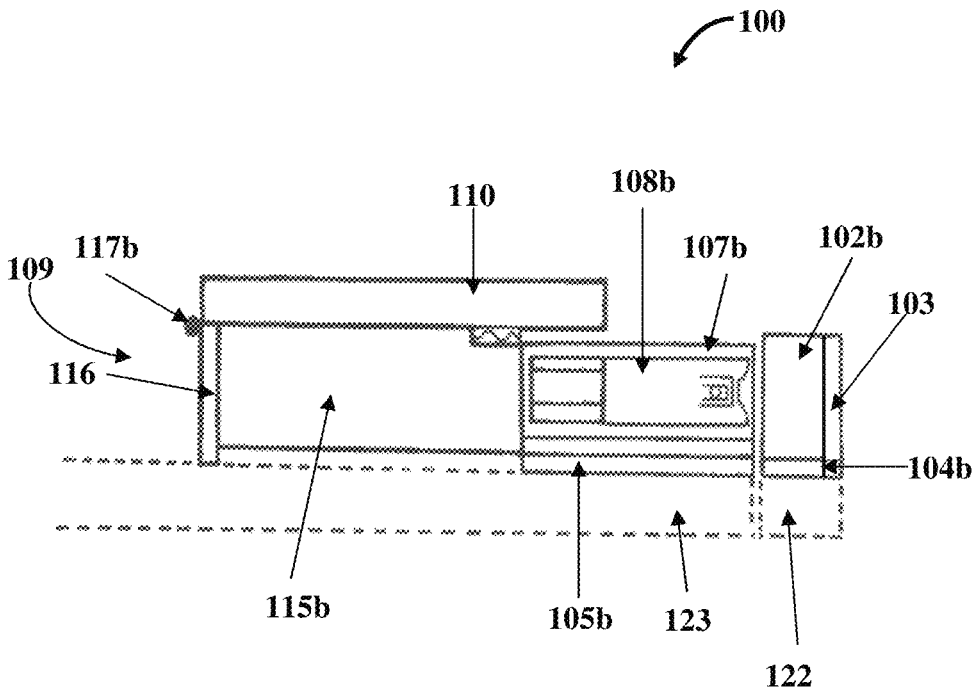
FIG. 8A exemplarily illustrates a bottom view of the multi-purpose concealing apparatus mounted on an external structure and opened using the slide elements of the multi-purpose concealing apparatus.

FIG. 8A exemplarily illustrates a bottom view of the multi-purpose concealing apparatus 100 mounted on an external structure, for example, a door 123, and opened using the slide elements 108*a* and 108*b* of the multi-purpose concealing apparatus 100 exemplarily illustrated in FIGS. 2A-2B. The multi-purpose concealing apparatus 100 in the open position exposes objects, for example, 124, 125, 126, and 127 positioned on the door 123 exemplarily illustrated in FIG. 4.

Figure 8B:
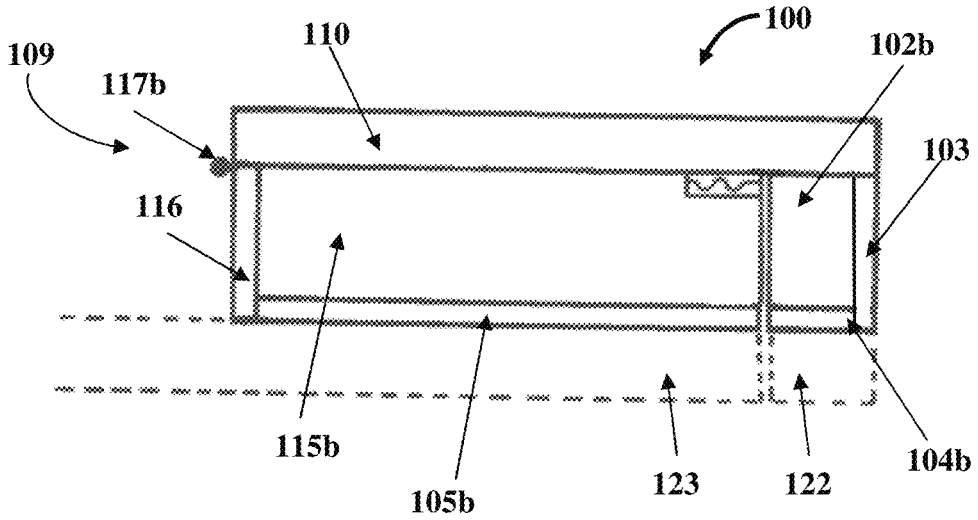
FIG. 8B exemplarily illustrates a bottom view of the multi-purpose concealing apparatus mounted on an external structure and closed using the slide elements of the multi-purpose concealing apparatus.

FIG. 8B exemplarily illustrates a bottom view of the multi-purpose concealing apparatus 100 mounted on an external structure, for example, a door 123, and closed using the slide elements 108*a* and 108*b* of the multi-purpose concealing apparatus 100 exemplarily illustrated in FIGS. 2A-2B. The multi-purpose concealing apparatus 100 in the closed position conceals objects, for example, 124, 125, 126, and 127 positioned on the door 123 exemplarily illustrated in FIG. 4.

Figure 9A:
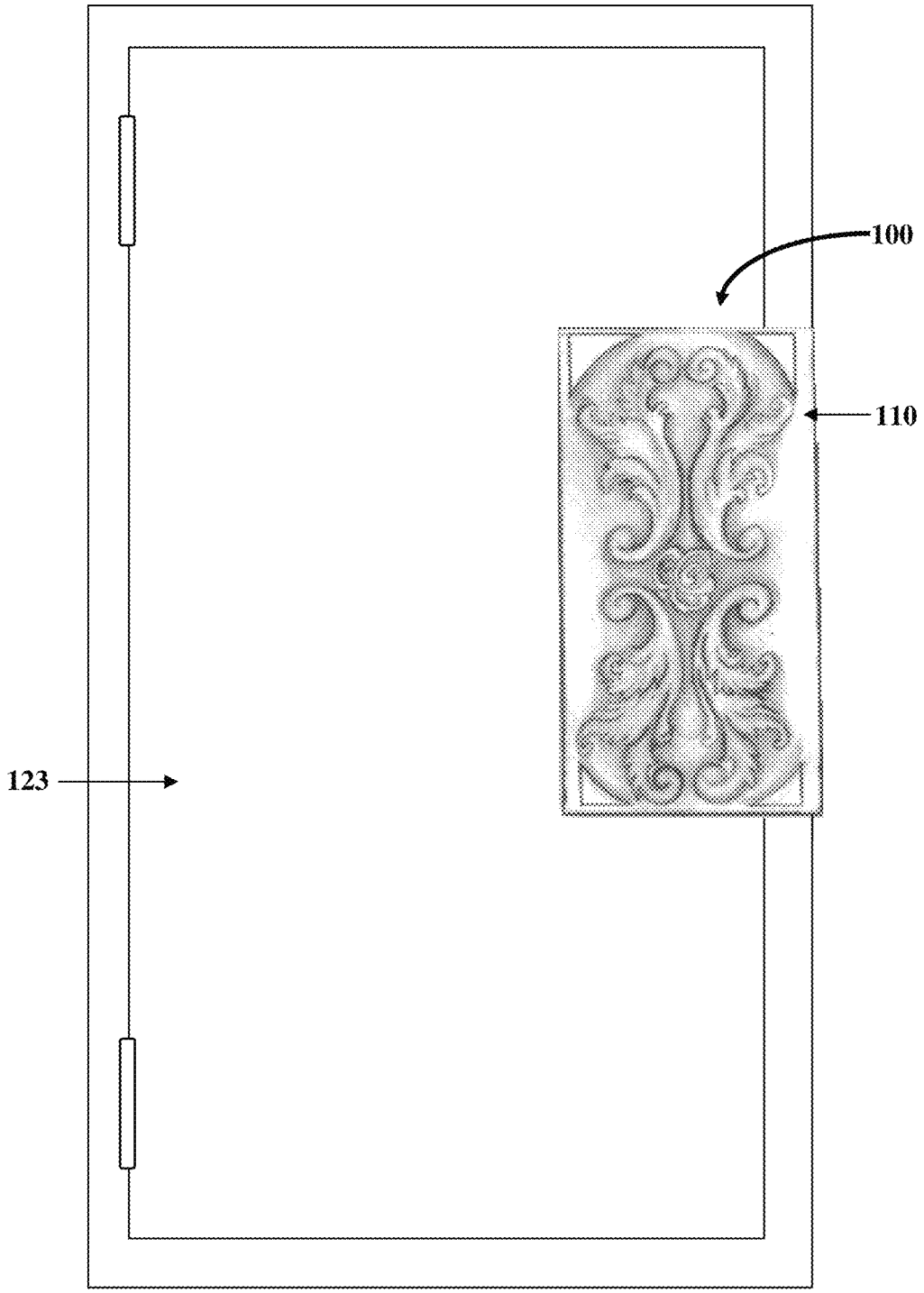
FIG. 9A exemplarily illustrates a front elevation view of an embodiment of the multi-purpose concealing apparatus positioned on a partial area of an external structure.

FIG. 9A exemplarily illustrates a front elevation view of an embodiment of the multi-purpose concealing apparatus 100 positioned on a partial area of an external structure, for example, a door 123. As exemplarily illustrated in FIG. 9A, the multi-purpose concealing apparatus 100 is in a closed position with the concealing member 110 in a closed condition, thereby concealing multiple objects, for example, 124, 125, 126, and 127 positioned on the partial area of the door 123 as exemplarily illustrated in FIGS. 9B-9C.

Figure 9B:
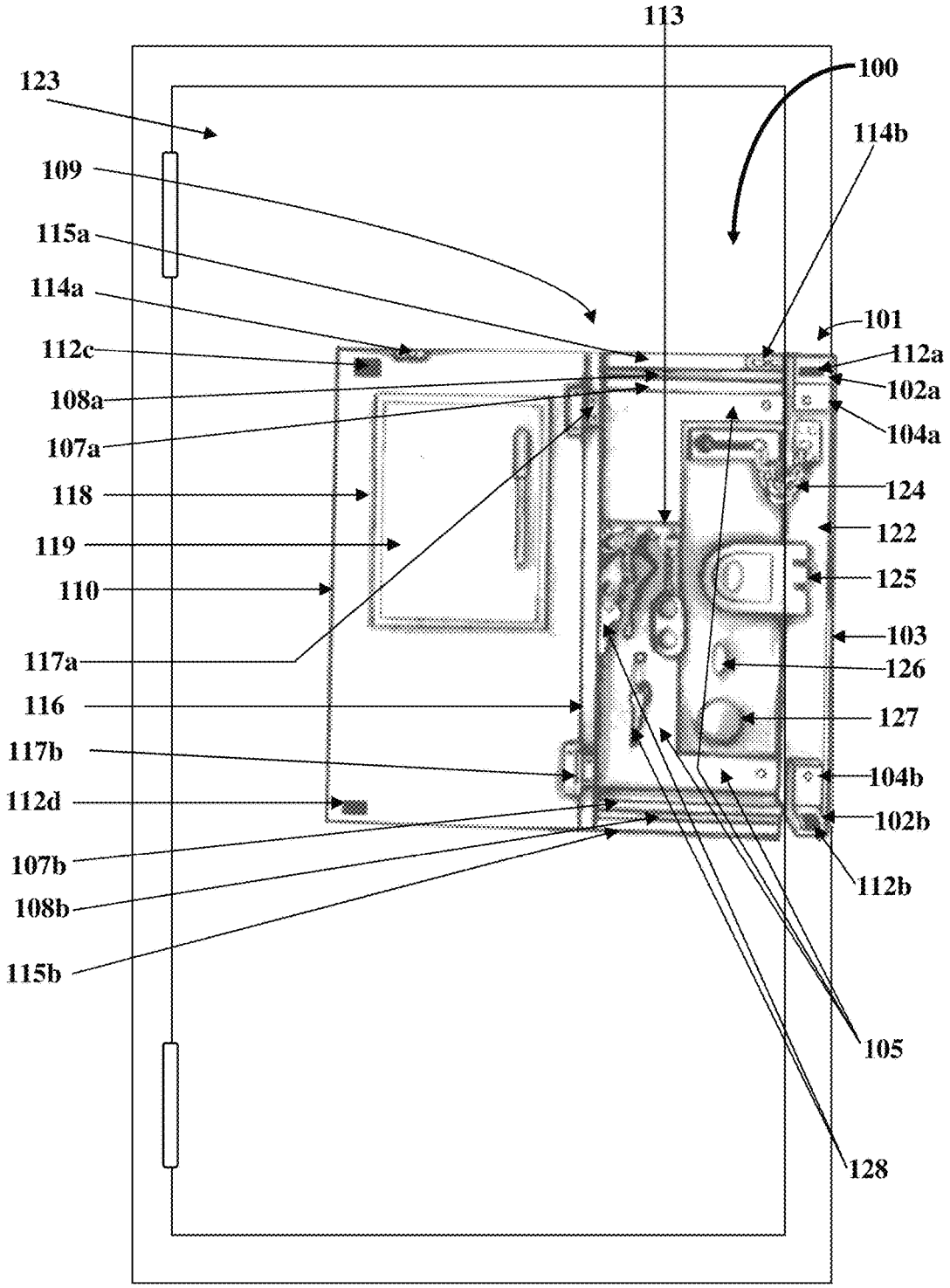
FIG. 9B exemplarily illustrates a front elevation view of the embodiment of the multi-purpose concealing apparatus positioned on a partial area of an external structure, showing the enclosing structure in a closed position and the concealing member opened via hinges to expose objects positioned on the partial area of the external structure.

FIG. 9B exemplarily illustrates a front elevation view of the embodiment of the multi-purpose concealing apparatus 100 positioned on a partial area of an external structure, for example, a door 123, showing the enclosing structure 109 in a closed position and the concealing member 110 opened via the hinges 117*a* and 117*b* to expose objects, for example, 124, 125, 126, and 127 positioned on the partial area of the external structure. The upper base panel 104*a* and the lower base panel 104*b* of the first base member 101 are fastened to the frame 122 of the door 123. The second base member 105 is fastened to the door 123. As exemplarily illustrated in FIG. 9B, the enclosing structure 109 of the multi-purpose concealing apparatus 100 encloses the second base member 105 in the closed position via the slide elements 108*a* and 108*b*. The ball catch 114*a* of the concealing member 110 is disengaged from the catch ball latch 114*b* that is positioned on the upper outer panel 115*a* of the enclosing structure 109 to open the concealing member 110 via the hinges 117*a* and 117*b* to expose the objects, for example, the chain lock 124, the bolt lock 125, the door lock 126, and the door knob 127 positioned on the door 123 and the key rack that hangs keys 128 positioned on the second base member 105. The concealing member 110 in the open condition also exposes the magnetic dry erase board 119 to allow a user to post items, for example, notices, reminders, pictures, signs, etc., thereon, or view items, for example, notices, reminders, etc., posted thereon. The concealing member 110 can then be closed by engaging the ball catch 114*a* of the concealing member 110 to the catch ball latch 114*b* positioned on the upper outer panel 115*a* of the enclosing structure 109 to conceal the objects, for example, 124, 125, 126, 127, and 128.

Figure 9C:
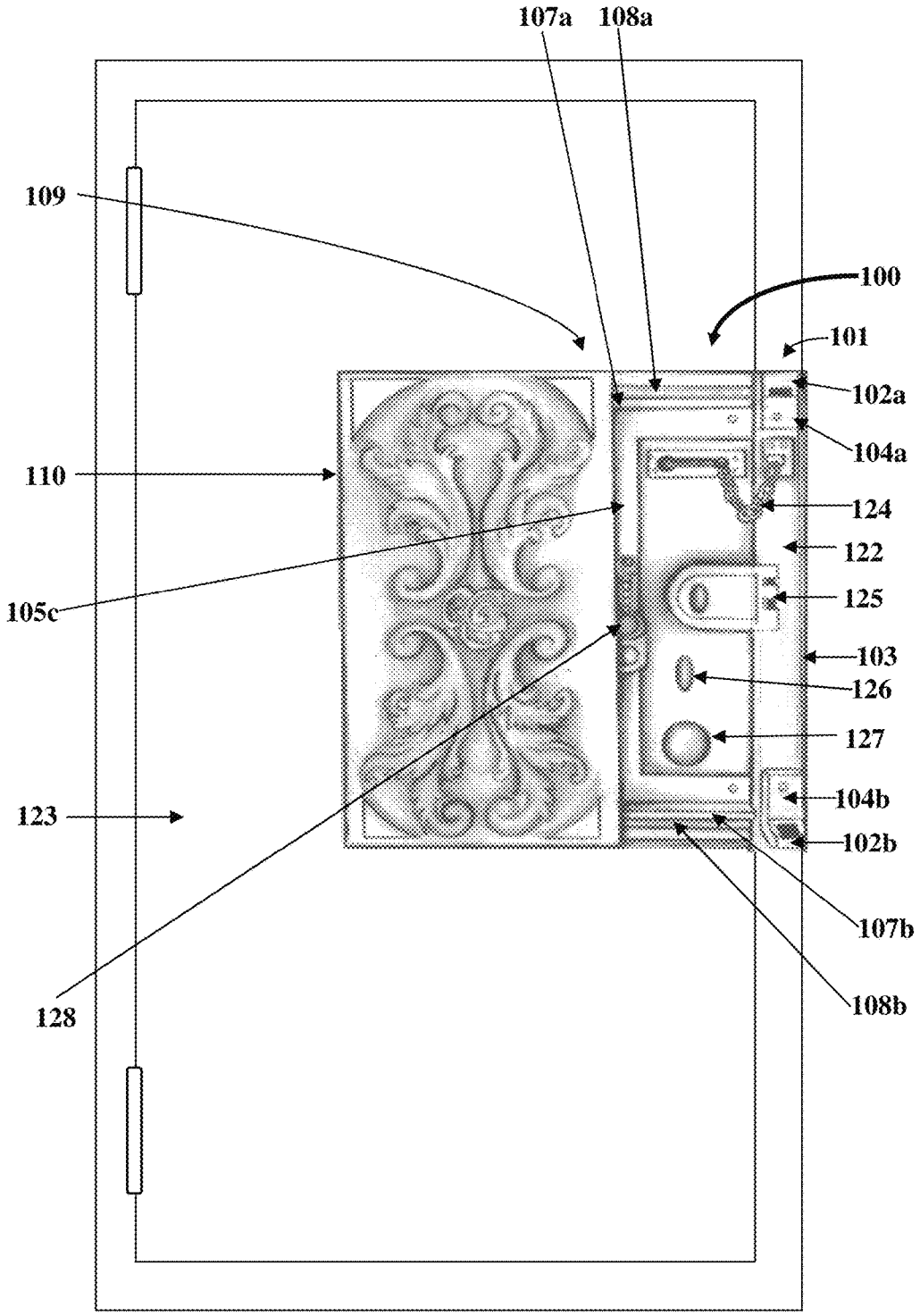
FIG. 9C exemplarily illustrates a front elevation view of the embodiment of the multi-purpose concealing apparatus positioned on a partial area of an external structure, showing the enclosing structure in an open position and the concealing member in a closed condition.

FIG. 9C exemplarily illustrates a front elevation view of the embodiment of the multi-purpose concealing apparatus 100 positioned on a partial area of an external structure, for example, a door 123, showing the enclosing structure 109 in an open position and the concealing member 110 in a closed condition. Multiple objects, for example, the chain lock 124, the bolt lock 125, the door lock 126, and the door knob 127 positioned on the door 123, and the key rack that hangs keys 128 can be exposed by opening the enclosing structure 109, that is, by drawing out the enclosing structure 109 from the second base member 105 using the slide elements 108*a* and 108*b*. That is, the upper outer panel 115*a* and the lower outer panel 115*b* of the enclosing structure 109 slide against the upper slide element 108*a* and the lower slide element 108*b* respectively, exemplarily illustrated in FIG. 9B, to open the enclosing structure 109. The enclosing structure 109 in the open position exposes the objects, for example, 124, 125, 126, and 127 positioned on the door 123. The enclosing structure 109 in the open position also exposes the key rack that hangs keys 128 positioned on the intermediate section 105*c* of the second base member 105.

The foregoing examples have been provided merely for the purpose of explanation and are in no way to be construed as limiting of the multi-purpose concealing apparatus 100 disclosed herein. While the multi-purpose concealing apparatus 100 has been described with reference to various embodiments, it is understood that the words, which have been used herein, are words of description and illustration, rather than words of limitation. Further, although the multi-purpose concealing apparatus 100 has been described herein with reference to particular means, materials, and embodiments, the multi-purpose concealing apparatus 100 is not intended to be limited to the particulars disclosed herein; rather, the multi-purpose concealing apparatus 100 extends to all functionally equivalent structures, methods and uses, such as are within the scope of the appended claims. Those skilled in the art, having the benefit of the teachings of this specification, may effect numerous modifications thereto and changes may be made without departing from the scope and spirit of the multi-purpose concealing apparatus 100 disclosed herein in its aspects.

I claim:

1. A multi-purpose concealing apparatus for concealing objects positioned on an external structure, the multi-purpose concealing apparatus comprising:

a first base member attached to a frame of the external structure, the first base member comprising an upper base panel, a lower base panel, and an upper support panel and a lower support panel connected by a distal brace, wherein the upper support panel and the lower support panel are attached substantially perpendicular to the upper base panel and the lower base panel respectively;

a second base member positioned on the external structure, adjacent to the first base member, wherein outer surfaces of the second base member are fixedly attached to the external structure, and wherein the second base member comprising an upper section and a lower section connected by an intermediate section defines a space for accommodating the objects positioned on the external structure;

an upper inner panel and a lower inner panel attached substantially perpendicular to the upper section and the lower section of the second base member respectively;

an upper slide element attached substantially parallel to an outer surface of the upper inner panel and substantially perpendicular to the upper section of the second base member;

a lower slide element attached substantially parallel to an outer surface of the lower inner panel and substantially perpendicular to the lower section of the second base member;

an enclosing structure comprising an upper outer panel and a lower outer panel connected by a rear panel, wherein the rear panel is connected to distal ends of the upper outer panel and the lower outer panel, and wherein an inner surface of the upper outer panel and an inner surface of the lower outer panel are configured to slide against an outer surface of the upper slide element and an outer surface of the lower slide element respectively, to enclose the second base member in a closed position, and wherein the enclosing structure defines a space for further accommodating the objects positioned on the external structure; and a concealing member connected to the rear panel of the enclosing structure via one or more hinges and positioned over the enclosed second base member to conceal the accommodated objects in the closed position.

2. The multi-purpose concealing apparatus of claim 1, further comprising one or more first magnetic elements attached to an inner surface of the concealing member and corresponding one or more second magnetic elements attached to the first base member, wherein the one or more first magnetic elements of the concealing member magnetically connect to the corresponding one or more second magnetic elements of the first base member for securing the concealing member to the first base member.

3. The multi-purpose concealing apparatus of claim 2, wherein the one or more first magnetic elements are attached to an upper section and a lower section of the inner surface of the concealing member to magnetically connect to the corresponding one or more second magnetic elements attached to the upper support panel and the lower support panel of the first base member respectively.

4. The multi-purpose concealing apparatus of claim 1, further comprising one or more latching elements attached to one or more of an upper section and a lower section of an inner surface of the concealing member and one or more of the upper outer panel and the lower outer panel of the enclosing structure respectively for securing the concealing member to the enclosing structure.

5. The multi-purpose concealing apparatus of claim 4, wherein each of the one or more latching elements comprises a ball catch positioned on the one or more of the upper section and the lower section of the inner surface of the concealing member, and a catch ball latch positioned on the one or more of the upper outer panel and the lower outer panel of the enclosing structure respectively, wherein the ball catch is configured to engageably connect to the catch ball latch to secure the concealing member to the enclosing structure.

6. The multi-purpose concealing apparatus of claim 1, wherein an inner surface of the second base member comprises an attachment section configured to attach one or more auxiliary objects.

7. The multi-purpose concealing apparatus of claim 1, wherein an inner surface of the concealing member comprises an attachment section configured to attach one or more auxiliary objects.

8. The multi-purpose concealing apparatus of claim 7, wherein the attachment section on the inner surface of the concealing member is a magnetic attachment section for detachably attaching the one or more auxiliary objects.

9. The multi-purpose concealing apparatus of claim 7, wherein the one or more auxiliary objects comprise a magnetic dry erase board for posting items thereon.

10. The multi-purpose concealing apparatus of claim 1, wherein the second base member is configured as a C shaped base member.

11. The multi-purpose concealing apparatus of claim 1 constructed to cover one of an entire area and a partial area of the external structure.

12. The multi-purpose concealing apparatus of claim 1, wherein an outer surface of the concealing member is configured as a display unit for displaying one or more decorative elements.

13. The multi-purpose concealing apparatus of claim 1, wherein an outer surface of the concealing member is configured with magnetic properties for magnetically attaching one or more decorative elements.

14. The multi-purpose concealing apparatus of claim 1, further comprising a decorative element configured on an outer surface of the concealing member.

15. A multi-purpose concealing apparatus for concealing objects positioned on an external structure, the multi-purpose concealing apparatus comprising:

a first base member attached to a frame of the external structure, the first base member comprising an upper base panel, a lower base panel, and an upper support panel and a lower support panel connected by a distal brace, wherein the upper support panel and the lower support panel are attached substantially perpendicular to the upper base panel and the lower base panel respectively;

a second base member positioned on the external structure, adjacent to the first base member, wherein outer surfaces of the second base member are fixedly attached to the external structure, and wherein the second base member comprising an upper section and a lower section connected by an intermediate section defines a space for accommodating the objects positioned on the external structure, and wherein an inner surface of the second base member comprises a first attachment section configured to attach one or more first auxiliary objects;

an upper inner panel and a lower inner panel attached substantially perpendicular to the upper section and the lower section of the second base member respectively;

an upper slide element attached substantially parallel to an outer surface of the upper inner panel and substantially perpendicular to the upper section of the second base member;

a lower slide element attached substantially parallel to an outer surface of the lower inner panel and substantially perpendicular to the lower section of the second base member;

an enclosing structure comprising an upper outer panel and a lower outer panel connected by a rear panel, wherein the rear panel is connected to distal ends of the upper outer panel and the lower outer panel, and wherein an inner surface of the upper outer panel and an inner surface of the lower outer panel are configured to slide against an outer surface of the upper slide element and an outer surface of the lower slide element respectively, to enclose the second base member in a closed position, and wherein the enclosing structure defines a space for further accommodating the objects positioned on the external structure;

a concealing member connected to the rear panel of the enclosing structure via one or more hinges and positioned over the enclosed second base member to conceal the accommodated objects in the closed position, wherein an inner surface of the concealing member comprises a second attachment section configured to attach one or more second auxiliary objects;

one or more first magnetic elements attached to the inner surface of the concealing member and corresponding one or more second magnetic elements attached to the first base member, wherein the one or more first magnetic elements of the concealing member magnetically connect to the corresponding one or more second magnetic elements of the first base member for securing the concealing member to the first base member; and one or more latching elements attached to one or more of an upper section and a lower section of the inner surface of the concealing member and one or more of the upper outer panel and the lower outer panel of the enclosing structure respectively for securing the concealing member to the enclosing structure.

16. The multi-purpose concealing apparatus of claim 15, wherein the one or more first magnetic elements are attached to the upper section and the lower section of the inner surface of the concealing member to magnetically connect to the corresponding one or more second magnetic elements attached to the upper support panel and the lower support panel of the first base member respectively.

17. The multi-purpose concealing apparatus of claim 15, wherein each of the one or more latching elements comprises a ball catch positioned on the one or more of the upper section and the lower section of the inner surface of the concealing member, and a catch ball latch positioned on the one or more of the upper outer panel and the lower outer panel of the enclosing structure respectively, wherein the ball catch is configured to engageably connect to the catch ball latch to secure the concealing member to the enclosing structure.

18. The multi-purpose concealing apparatus of claim 15, wherein the second attachment section on the inner surface of the concealing member is a magnetic attachment section for detachably attaching the one or more second auxiliary objects, and wherein the one or more second auxiliary objects comprise a magnetic dry erase board for posting items thereon.

19. The multi-purpose concealing apparatus of claim 15 constructed to cover one of an entire area and a partial area of the external structure.

20. The multi-purpose concealing apparatus of claim 15, wherein an outer surface of the concealing member is configured as a display unit for displaying one or more decorative elements.

* * * * *